US011703782B2

(12) United States Patent
Koyanagi et al.

(10) Patent No.: US 11,703,782 B2
(45) Date of Patent: Jul. 18, 2023

(54) FIXING DEVICE AND IMAGE FORMING APPARATUS

(71) Applicant: FUJIFILM Business Innovation Corp., Tokyo (JP)

(72) Inventors: Kiyoshi Koyanagi, Kanagawa (JP); Toko Hara, Kanagawa (JP); Toshiyuki Miyata, Kanagawa (JP); Kazuyoshi Itoh, Kanagawa (JP); Keitaro Mori, Kanagawa (JP); Motoharu Nakao, Kanagawa (JP); Sou Morizaki, Kanagawa (JP); Toru Inoue, Kanagawa (JP)

(73) Assignee: FUJTFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/489,821

(22) Filed: Sep. 30, 2021

(65) Prior Publication Data

US 2022/0382195 A1 Dec. 1, 2022

(30) Foreign Application Priority Data

May 25, 2021 (JP) ..... 2021-087854

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01); *G03G 2215/2038* (2013.01)

(58) Field of Classification Search
CPC ..... G03G 15/2017; G03G 15/2039; G03G 15/2053; G03G 2215/2003
See application file for complete search history.

(56) References Cited

U.S. PATENT DOCUMENTS 6,323,460 B1 * 11/2001 Ohtsuka ..... G03G 15/2064 219/539

FOREIGN PATENT DOCUMENTS

JP H06230780 8/1994
JP 2004117800 4/2004

* cited by examiner

*Primary Examiner* — Thomas S Giampaolo, II
(74) *Attorney, Agent, or Firm* — JCIPRNET

(57) ABSTRACT

A fixing device includes a movable belt; and a planar heat-generating section that is in contact with the belt and in which, among plural heat-generating portions provided in a movement direction of the belt, a heat-generating portion on an upstream side in the movement direction of the belt has a larger heat generation amount than a heat-generating portion on a downstream side.

15 Claims, 9 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2021-087854 filed May 25, 2021.

BACKGROUND

(i) Technical Field

The present invention relates to a fixing device and an image forming apparatus.

(ii) Related Art

In the related art, as techniques related to fixing devices, for example, fixing devices disclosed in JP1994-230780A, JP2004-117800A or the like have already been proposed.

JP1994-230780A is a heating element in which a plurality of power feed electrodes and resistance heating elements are formed on one side of a ceramic base material, and the resistance heating elements form an outward path and a return path between the power feed electrodes.

In JP2004-117800A, in a configuration in which a heating section and a rotating body including the heating section are provided, the rotating body moves at a constant speed with a transfer material carrying an unfixed image, a pressure roller that pressurizes and is in pressure contact with the rotating body to form a nip is provided, the heating section consists of a plurality of heat-generating elements that can be independently driven, and the plurality of heating elements are arranged in a paper transport direction within the nip, the heat generation distribution of each of the plurality of heat-generating elements during the heating of a first surface and the heat generation distribution of the heat-generating element during the heating of a second surface are different from each other, and the heat generation distribution of the second surface is adjusted such that a heat generation peak thereof is brought closer to the downstream side than the heat generation peak of the first surface.

SUMMARY

Aspects of non-limiting embodiments of the present disclosure relate to a fixing device and an image forming apparatus that make the temperature distribution of a planar heat-generating section in a movement direction of a belt uniform as compared to a case where a plurality of heat-generating portions provided in the movement direction of the belt have the same heat generation amount.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including a movable belt; and a planar heat-generating section that is in contact with the belt and in which, among a plurality of heat-generating portions provided in a movement direction of the belt, a heat-generating portion on an upstream side in the movement direction of the belt has a larger heat generation amount than a heat-generating portion on a downstream side.

BRIEF DESCRIPTION OF THE DRAWINGS

Exemplary embodiment (s) of the present invention will be described in detail based on the following figures, wherein.

DETAILED DESCRIPTION

Hereinafter, exemplary embodiments of the present invention will be described with reference to the drawings.

Exemplary Embodiment 1

Figure 1:
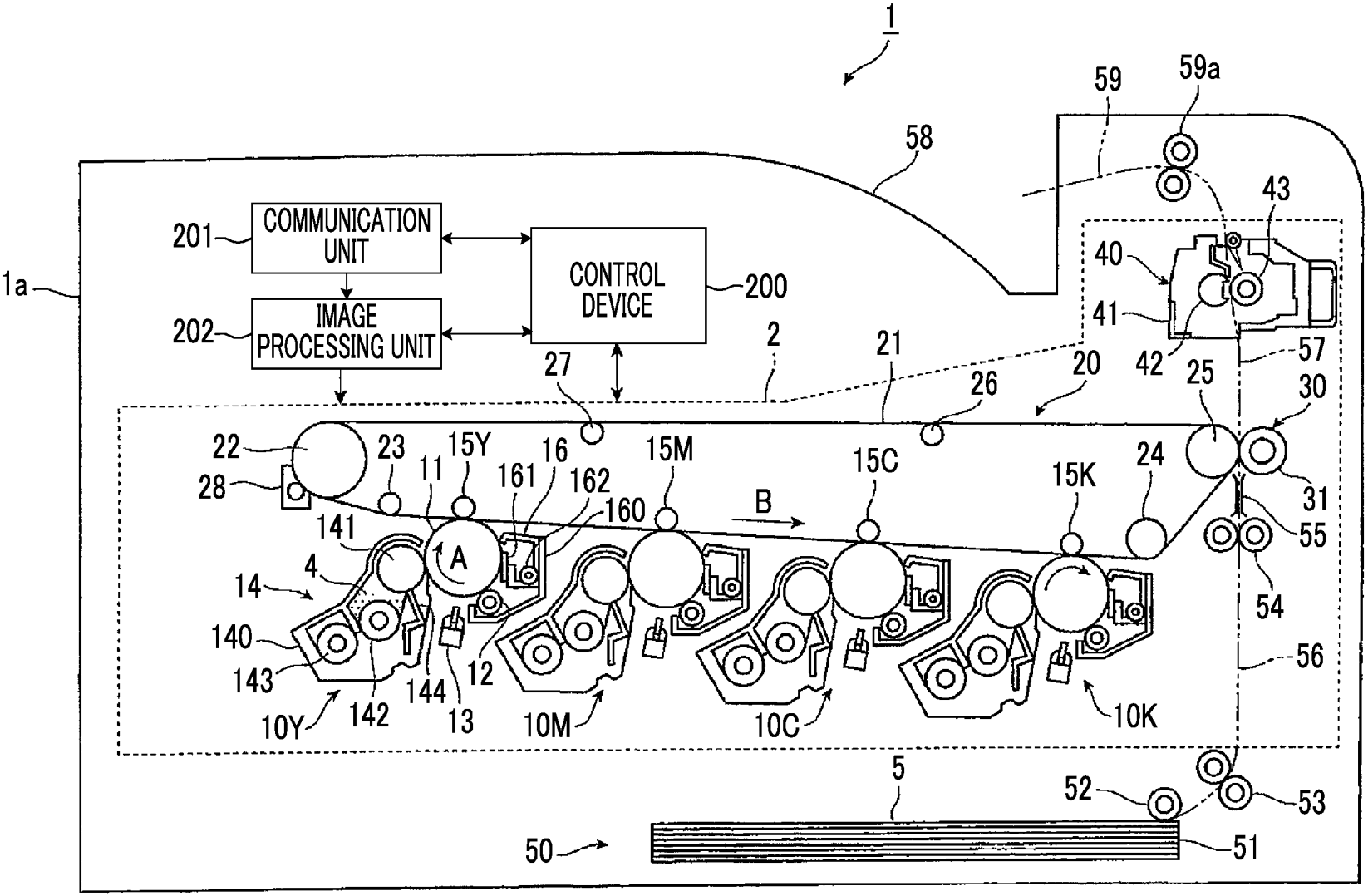
FIG. 1 is an overall configuration diagram showing an image forming apparatus to which a fixing device according to Exemplary Embodiment 1 of the present invention is applied.

FIG. 1 shows an image forming apparatus to which a fixing device according to Exemplary Embodiment 1 is applied.

Overall Configuration of Image Forming Apparatus

The image forming apparatus 1 according to Exemplary Embodiment 1 is configured as, for example, a color printer. The image forming apparatus 1 includes a plurality of image creating devices 10 that form toner images developed with a toner constituting a developer 4, an intermediate transfer device 20 that holds a toner image formed by each image creating device 10 and finally transports the held toner image to a secondary transfer position where the transported toner image is secondarily transferred to recording paper 5 serving as an example of a recording medium, a paper feed device 50 that accommodates and transports a required recording paper 5 to be supplied to the secondary transfer position of the intermediate transfer device 20, and a fixing device 40 that fixes the toner image on the recording paper 5 secondarily transferred by the intermediate transfer device 20. The plurality of image creating devices 10 and the intermediate transfer device 20 constitute an image forming section 2 that forms an image on the recording paper 5. In addition, 1*a* in the figure indicates an apparatus body of the image forming apparatus 1, and the apparatus body 1*a* is formed of a supporting structural member, an exterior cover, and the like. Additionally, a two-dot chain line in the figure indicates a transport route along which the recording paper 5 is transported in the apparatus body 1*a*.

The image creating device 10 includes four image creating devices 10Y, 10M, 10C, and 10K that exclusively form toner images in four colors of yellow (Y), magenta (M), cyan (C), and black (K), respectively. The four image creating devices 10 (Y, M, C, K) are disposed to be arranged in a row in an inclined state in an internal space of the apparatus body 1*a*.

The four image creating devices 10 include yellow (Y), magenta (M), and cyan (C) color image creating devices 10 (Y, M, C) and a black (K) image creating device 10K. The black image creating device 10K is disposed on the most downstream side along a movement direction B of the intermediate transfer belt 21 of the intermediate transfer device 20. The image forming apparatus 1 includes, as image forming modes, a full-color mode in which the color image creating devices 10 (Y, M, C) and the black (K) image creating device 10K are operated to form a full-color image, and a black-and-white mode in which only the black (K) image creating device 10K is operated to form a black-and-white (monochrome) image.

As shown in FIG. 1, each of the image creating devices 10 (Y, M, C, K) includes a rotating photoconductive drum 11 serving as an example of an image holder, and each device serving as an example of the following toner image forming section is disposed around the photoconductive drum 11. The devices are a charging device 12 that charges a peripheral surface (image holding surface) capable of forming an image on each photoconductive drum 11 to a required potential, an exposure device 13 that irradiates the charged peripheral surface of the photoconductive drum 11 with the light based on information (signal) of an image to form an electrostatic latent image (for each color) having a potential difference, a developing device 14 (Y, M, C, K) that develop the electrostatic latent image with a toner of a developer 4 for a corresponding color (Y, M, C, K) to form a toner image, a primary transfer device 15 (Y, M, C, K) that transfer each toner image to the intermediate transfer device 20, and a drum cleaning device 16 (Y, M, C, K) that remove and clean a deposit such as the toner remaining on and adhering to the image holding surface of the photoconductive drum 11 after the primary transfer.

The photoconductive drum 11 has an image holding surface having a photoconductive layer (photosensitive layer) made of a photosensitive material formed on a peripheral surface of a cylindrical or columnar base material to be subjected to ground treatment. The photoconductive drum 11 is supported such that power is transmitted thereto from a drive device (not shown) and the photoconductive drum 11 rotates in a direction indicated by arrow A.

The charging device 12 includes a contact type charging roll that is disposed in contact with the photoconductive drum 11. A charging voltage is supplied to the charging device 12. As the charging voltage, in a case where the developing device 14 performs reverse development, a voltage or current having the same polarity as the charging polarity of the toner supplied from the developing device 14 is supplied. In addition, as the charging device 12, a non-contact type charging device such as a scorotron disposed on the surface of the photoconductive drum 11 in a non-contact state may be used.

The exposure device 13 consists of an LED printhead that irradiates the photoconductive drum 11 with the light according to the image information by a plurality of light emitting diodes (LEDs) serving as a plurality of light emitting elements arranged in an axial direction of the photoconductive drum 11 to form an electrostatic latent image. In addition, as the exposure device 13, one that deflects and scans a laser beam configured in accordance with the image information in the axial direction of the photoconductive drum 11 may be used.

All of the developing devices 14 (Y, M, C, K) are configured such that a developing roll 141 that holds the developer 4 to transport the developer 4 to a developing region that faces the photoconductive drum 11, agitating and transporting members 142 and 143 such as two screw augers that transports the developer 4 to pass through the developing roll 141 while agitating the developer 4, a layer thickness regulating member 144 that regulates the amount (layer thickness) of the developer held on the developing roll 141, and the like are disposed inside a housing 140 in which an opening portion and an accommodation chamber of the developer are formed. A developing voltage is supplied to the developing device 14 from a power supply device (not shown) between the developing roll 141 and the photoconductive drum 11. Additionally, the developing roll 141 and the agitating and transporting members 142 and 143 rotate in a required direction by transmitting power from the drive device (not shown). Moreover, as the four-color developers 4 (Y, M, C, K), two-component developers containing a non-magnetic toner and a magnetic carrier are used.

The primary transfer device 15 (Y, M, C, K) is a contact type transfer device including a primary transfer roll that rotates around the photoconductive drum 11 in contact therewith via the intermediate transfer belt 21 and is supplied with a primary transfer voltage. As the primary transfer voltage, a direct-current voltage indicating a polarity opposite to the charging polarity of the toner is supplied from the power supply device (not shown).

The drum cleaning device 16 includes a container-shaped main body 160 that partially opens, a cleaning plate 161 that is disposed to be in contact with the peripheral surface of the photoconductive drum 11 after the primary transfer at a required pressure and removes and cleans deposits such as residual toner, a delivery member 162 such as a screw auger that recovers the deposits such as toner removed by the cleaning plate 161 and transports the deposits for delivery to a recovery system (not shown), and the like. As the cleaning plate 161, a plate-shaped member (for example, a blade) made of a material such as rubber is used.

As shown in FIG. 1, the intermediate transfer device 20 is disposed to be present at a position above each image creating device 10 (Y, M, C, K). The intermediate transfer device 20 includes an intermediate transfer belt 21 that rotates in a direction indicated by arrow B while passing through a primary transfer position between the photoconductive drum 11 and the primary transfer device 15 (primary transfer roll), a plurality of belt support rolls 22 to 27 that hold the intermediate transfer belt 21 in a desired state from an inner surface thereof and rotatably support the intermediate transfer belt 21, a secondary transfer device 30 serving as an example of a secondary transfer section that is disposed on an outer peripheral surface (image holding surface) side of the intermediate transfer belt 21 supported by the belt support roll 25 and secondarily transfers an toner image on the intermediate transfer belt 21 to the recording paper 5, and a belt cleaning device 28 that removes and cleans deposits such as toner and paper dust remaining on and adhering to the outer peripheral surface of the intermediate transfer belt 21 after passing through the secondary transfer device 30.

As the intermediate transfer belt 21, for example, an endless belt made of a material in which a resistance modifier such as carbon black is dispersed in a synthetic resin such as a polyimide resin or a polyamide resin is used. Additionally, the belt support roll 22 is configured as a drive roll that is rotationally driven by the drive device (not shown) that also serves as a counter roll of the belt cleaning device 28, the belt support roll 23 is configured as a face-out roll that forms an image forming surface of the intermediate transfer belt 21, the belt support roll 24 is configured as a tension applying roll that applies tension to the intermediate transfer belt 21, the belt support roll 25 is configured as a counter roll that faces the secondary transfer device 30, and the belt support rolls 26 and 27 are configured as driven rolls that support the traveling position of the intermediate transfer belt 21.

As shown in FIG. 1, the secondary transfer device 30 is a contact type transfer device including a secondary transfer roll 31, which rotates in contact with a peripheral surface of the intermediate transfer belt 21 and is supplied with a secondary transfer voltage, at the secondary transfer position that is an outer peripheral surface portion of the intermediate transfer belt 21 supported by the belt support roll 25 in the intermediate transfer device 20. Additionally, a direct-current voltage showing the opposite polarity or the same polarity as the charging polarity of the toner is supplied to the secondary transfer roll 31 or the belt support roll 25 of the intermediate transfer device 20 from the power supply device (not shown) as the secondary transfer voltage.

The fixing device 40 is configured such that a heating belt 42 that is rotated in a direction indicated by an arrow and heated by a heating section such that the surface temperature is maintained at a predetermined temperature, a pressure roll 43 or the like that is in contact with the heating belt 42 at a predetermined pressure and rotates in a driven manner substantially in an axial direction of the heating belt 42, and the like are disposed inside the housing 41 in which an introduction port and an ejection port of the recording paper 5 are formed. In the fixing device 40, a contact portion where the heating belt 42 and the pressure roll 43 are in contact with each other is a fixing treatment portion that performs a required fixing treatment (heating and pressurizing). In addition, the fixing device 40 will be described in detail below.

The paper feed device 50 is disposed to be present at a position below the image creating device 10 (Y, M, C, K). The paper feed device 50 includes a single (or a plurality of) paper accommodation body 51 that accommodates the recording paper 5 of a desired size, type, or the like in a loaded state, and delivery devices 52 and 53 that deliver recording paper 5 sheet by sheet from the paper accommodation body 51. The paper accommodation body 51 is attached so that the paper accommodation body 51 can be pulled out to a front side (a side surface facing a user during operation) of the apparatus body 1*a*, for example.

Examples of the recording paper 5 include thin paper such as plain paper and tracing paper, OHP sheets, or the like, which are used in electrophotographic copying machines and printers. In order to further improve the smoothness of an image surface after fixing, for example, it is preferable that the surface of the recording paper 5 is as smooth as possible. For example, coated paper in which the surface of plain paper is coated with resin or the like, for example, so-called thick paper such as art paper for printing, or the like having a relatively large basis weight can also be used.

A paper feed transport route 56 including a single or a plurality of paper transport roll pairs 54 and transport guides 55, which transport the recording paper 5 delivered from the paper feed device 50 to the secondary transfer position, is provided between the paper feed device 50 and the secondary transfer device 30. The paper transport roll pair 54 disposed at a position immediately before the secondary transfer position in the paper feed transport route 56 is configured as, for example, a roll (registration roll) that adjusts the transport timing of the recording paper 5. Additionally, a paper transport route 57 for transporting the recording paper 5 after the secondary transfer, which is delivered from the secondary transfer device 30, to the fixing device 40 is provided between the secondary transfer device 30 and the fixing device 40. Moreover, an ejection transport route 59 including a paper ejection roll pair 59*a* for ejecting the recording paper 5 after fixing, which is delivered from the fixing device 40 by an outlet roll 36, to a paper ejection portion 58 on an upper portion of the apparatus body 1*a* is provided in a portion of the image forming apparatus 1 near the paper ejection port formed in the apparatus body 1*a*.

Reference sign 1200 in FIG. 1 indicates a control device that comprehensively controls the operation of the image forming apparatus 1. The control device 200 includes a central processing unit (CPU), a read only memory (ROM), a random access memory (RAM) (not shown), a bus for connecting the CPU, the ROM, and the like to each other, a communication interface, and the like. Additionally, reference sign 201 indicates a communication unit in which the image forming apparatus 1 communicates with an external device, and reference sign 202 indicates an image processing unit that processes image information input via the communication unit 201.

Operation of Image Forming Apparatus

Hereinafter, the basic image forming operation by the image forming apparatus 1 will be described.

Here, first, the operation in the full-color mode in which a full-color image configured by combining toner images of four colors (Y, M, C, K) is formed using the four image creating devices 10 (Y, M, C, K) will be is described.

In a case where the image forming apparatus 1 receives image information and request command information for a full-color image forming operation (print) from a personal computer, an image reading device, or the like (not shown) via the communication unit 201, the control device 200 starts the four image creating devices 10 (Y, M, C, K), the intermediate transfer device 20, the secondary transfer device 30, the fixing device 40, and the like.

Then, in each image creating device 10 (Y, M, C, K), as shown in FIG. 1, each photoconductive drum 11 first rotates in the direction indicated by the arrow A, and each charging device 12 charges the surface of the photoconductive drum 11 to a required polarity (negative polarity in Exemplary Embodiment 1) and a required potential. Subsequently, the exposure device 13 irradiates the surface of the photoconductive drum 11 after charging with the light emitted on the basis of image signals obtained by converting the image information input to the image forming apparatus 1 into each color component (Y, M, C, K) by the image processing unit 202, and forms an electrostatic latent image of each color component configured with a required potential difference on the surface thereof.

Subsequently, each image creating device 10 (Y, M, C, K) supplies a toner of a corresponding color (Y, M, C, K) charged with a required polarity (negative polarity) from the developing rolls 141 to the electrostatic latent image of each color component formed on the photoconductive drum 11 and causes the toner to electrostatically adhere to the electrostatic latent image to development. By virtue of this development, the electrostatic latent images of the respective color components formed on the respective photoconductive drums 11 are visualized as toner images of four colors (Y, M, C, K) developed with the toners of the corresponding colors.

Subsequently, in a case where the toner image of each color formed on the photoconductive drum 11 of each image creating device 10 (Y, M, C, K) is transported to the primary transfer position, the primary transfer device 15 (Y, M, C, K) primarily transfers the toner image of each color in a state in which the toner image of each color is sequentially superimposed on the intermediate transfer belt 21 while rotating in the direction indicated by the arrow B of the intermediate transfer device 20.

Additionally, in each image creating device 10 (Y, M, C, K) in which the primary transfer is completed, the drum cleaning device 16 removes deposits to scrape off the deposits and cleans the surface of the photoconductive drum 11. Accordingly, each image creating device 10 (Y, M, C, K) is in a state in which the next image creating operation can be performed.

Subsequently, the intermediate transfer device 20 holds the toner image that is primarily transferred by the rotation of the intermediate transfer belt 21 and transports the toner image to the secondary transfer position. Meanwhile, in the paper feed device 50, the required recording paper 5 is delivered to the paper feed transport route 56 in conformity with the image creating operation. In the paper feed transport route 56, the paper transport roll pair 54 serving as the registration roll delivers and supplies the recording paper 5 to the secondary transfer position in conformity with a transfer timing.

At the secondary transfer position, the secondary transfer device 30 collectively secondarily transfers the toner image on the intermediate transfer belt 21 to the recording paper 5. Additionally, in the intermediate transfer device 20 in which the secondary transfer is completed, the belt cleaning device 28 removes and cleans the deposits such as toner remaining on the surface of the intermediate transfer belt 21 after the secondary transfer.

Subsequently, the recording paper 5 on which the toner image is secondarily transferred is peeled off from the intermediate transfer belt 21 and then transported to the fixing device 40 via the paper transport route 57. In the fixing device 40, by introducing and passing the recording paper 5 after the secondary transfer into and through the contact portion between the rotating heating belt 42 and the pressure roll 43, the required fixing treatment (heating and pressurizing) is performed, and an unfixed toner image is fixed on the recording paper 5. Finally, the recording paper 5 after the fixing is completed is ejected to, for example, the paper ejection portion 58 installed in the upper portion of the apparatus body 1*a* by the paper ejection roll pair 59*a*.

By the above operation, the recording paper 5 on which the full-color image configured by combining the toner images of four colors is formed is output.

Configuration of Fixing Device

Figure 2:
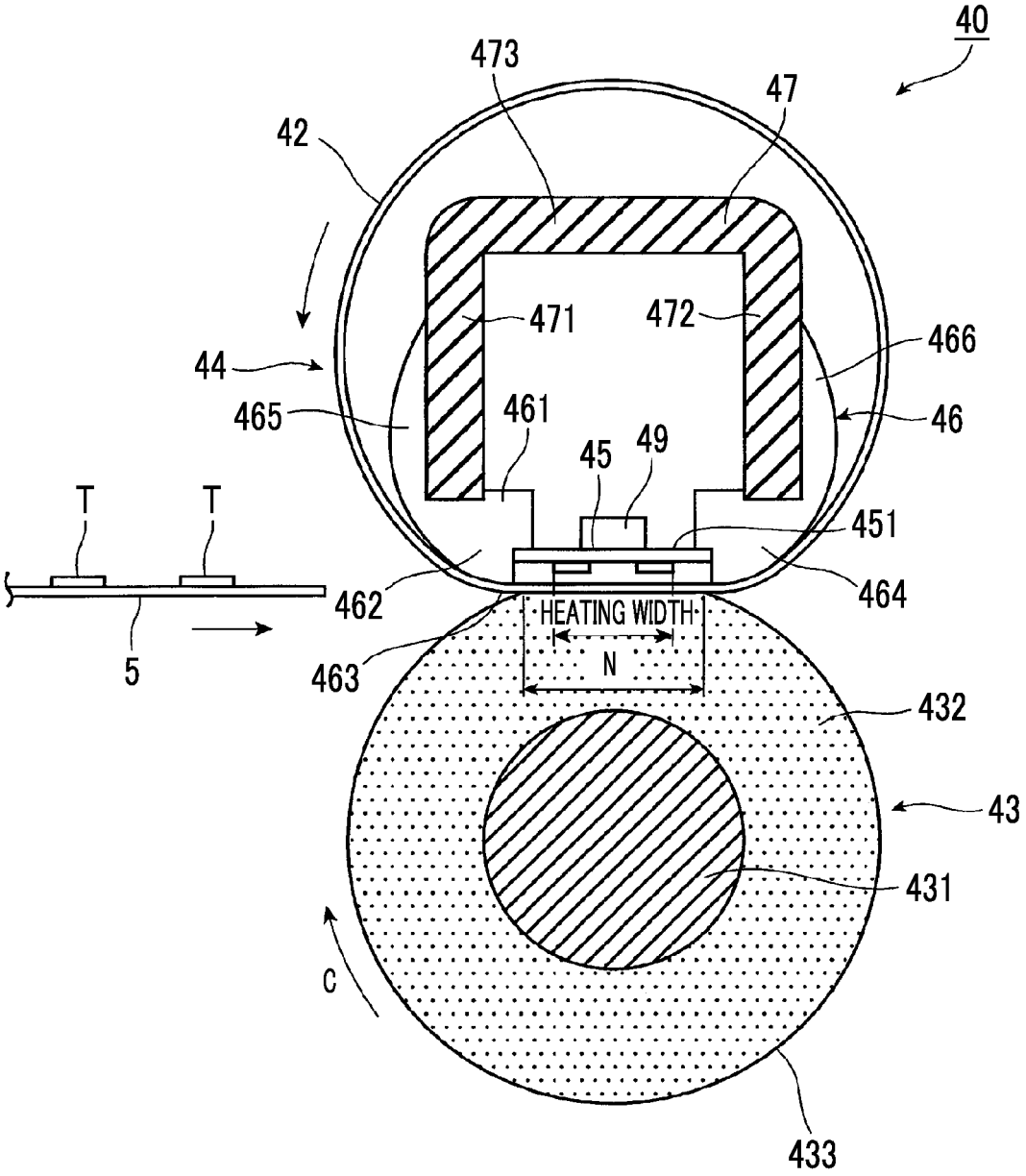
FIG. 2 is a cross-sectional configuration diagram showing the fixing device according to Exemplary Embodiment 1 of the present invention.

FIG. 2 is a cross-sectional configuration diagram showing the fixing device according to Exemplary Embodiment 1.

As shown in FIG. 2, the fixing device 40 generally includes a heating unit 44 having the heating belt 42 serving as an example of a rotating endless belt, and the pressure roll 43 serving as an example of a rotating body being in pressure contact with the heating unit 44. A fixing nip portion N serving as an example of a pressure contact portion, which is a region through which the recording paper 5 serving as an example of a recording medium holding an unfixed toner image T serving as an example of an unfixed image passes, is formed between the heating belt 42 and the pressure roll 43. In addition, the recording paper 5 is transported with a center in a direction intersecting a transport direction as a reference (so-called center registration).

As shown in FIG. 1, the fixing device 40 is disposed such that the heating belt 42 and the pressure roll 43 face each other in a substantially horizontal direction in order to perform the fixing treatment on the recording paper 5 transported in an extension direction, in the paper transport route 57 along which the recording paper 5 is transported from a lower side toward an upper side in a vertical direction. However, in FIG. 2, for convenience, the heating belt 42 and the pressure roll 43 are shown in an upward-downward direction.

As shown in FIG. 2, the heating unit 44 includes the heating belt 42, a ceramic heater 45 serving as an example of a planar heat-generating section (planar heat-generating element) that is disposed inside the heating belt 42 and heats the heating belt 42, a holding member 46 serving as an example of a holding section that is also disposed inside the heating belt 42 and holds the ceramic heater 45 to be in pressure contact with the surface of the pressure roll 43 via the heating belt 42, a support member 47 serving as an example of a support section that is disposed inside the heating belt 42 and supports the holding member 46 to be in pressure contact with the pressure roll 43.

In addition, in the ceramic heater 45 serving as an example of the planar heat-generating section, a heat-generating portion itself is not necessarily planar. Even in a case where the heat-generating portion may be linearly formed, a lower end surface (heating surface) of the ceramic heater 45 that heats the heating belt 42 may be planar. Additionally, the lower end surface (heating surface) of the ceramic heater 45 is not necessarily a flat surface and may have a curved surface shape.

Figure 3:
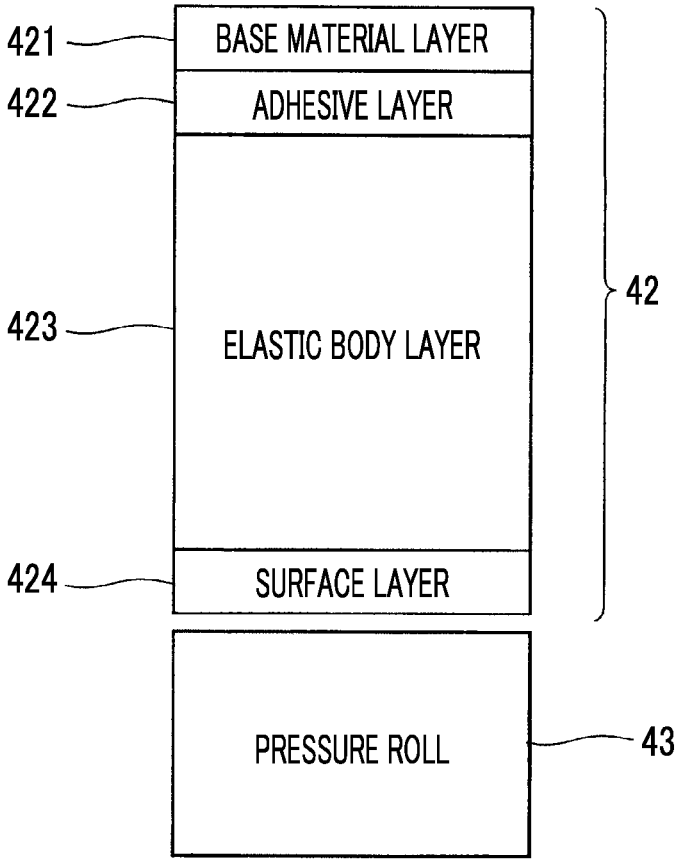
FIG. 3 is a cross-sectional configuration diagram showing a heating belt.

The heating belt 42 is made of a material having flexibility and is configured as an endless belt in which a free shape thereof is thin-walled cylindrical in a state before mounting. In addition, the shape of the belt is not limited to the endless shape as in the present example, but may be a belt having both ends. In the case of the belt having both ends, a type in which the belt is wound around two rolls from both ends of the belt and moved between the two rolls may be adopted. As shown in FIG. 3, the heating belt 42 has a base material layer 421 that is disposed on the ceramic heater 45 side, an elastic body layer 423 that is coated on the surface of the base material layer 421 via an adhesive layer 422, and a surface layer 424 that is coated on the surface of the elastic body layer 423 directly or via an adhesive layer (not shown). The heating belt 42 does not necessarily include all of the base material layer 421, the adhesive layer 422, the elastic body layer 423, and a release layer 433, and may include the base material layer 421, the surface layer 424, and the like. The base material layer 421 is formed using a heat-resistant synthetic resin such as polyimide, polyamide, or polyimideamide as a component. The elastic body layer 423 is made of a heat-resistant elastic body such as silicone rubber or fluororubber. The surface layer 424 is formed of perfluoroalkoxyalkane (PFA), polytetrafluoroethylene (PTFE), or the like. The thickness of the heating belt 42 can be set to, for example, about 50 μm to 200 μm.

The base material layer 421 contains, as necessary, a heat-resistant synthetic resin such as polyimide, polyamide, or polyimideamide as a component, and a filler such as carbon nanotubes, carbon fibers, or glass fibers is blended to improve the characteristics such as the thermal conductivity of the heating belt 42. As the filler, for example, the carbon nanotubes are desirable from the viewpoint of high thermal conductivity, low dynamic friction coefficient, and wear resistance.

As shown in FIG. 2, the ceramic heater 45 includes a ceramic substrate 451 serving as an example of an insulating substrate, a plurality of first and second heat-generating portions $\mathbf{452}_1$ and $\mathbf{452}_2$ linearly formed in a longitudinal direction on the surface of the substrate 451, and a coating layer 455 made of glass or the like that is coated on the surfaces of the first and second heat-generating portions $\mathbf{452}_1$ and $\mathbf{452}_2$.

The holding member 46 is made of, for example, a heat-resistant synthetic resin integrally molded into a required shape by injection molding or the like. Examples of the heat-resistant synthetic resin include liquid crystal polymer (LCP), polyetheretherketone (PEEK), polyphenylene sulfide (PPS), polyethersulfone (PES), polyamideimide (PAI), polytetrafluoroethylene (PTFE), polychlorotrifluoroethylene (PCTFE), polyvinylidene fluoride (PVDF), or a composite material thereof.

Figure 9:
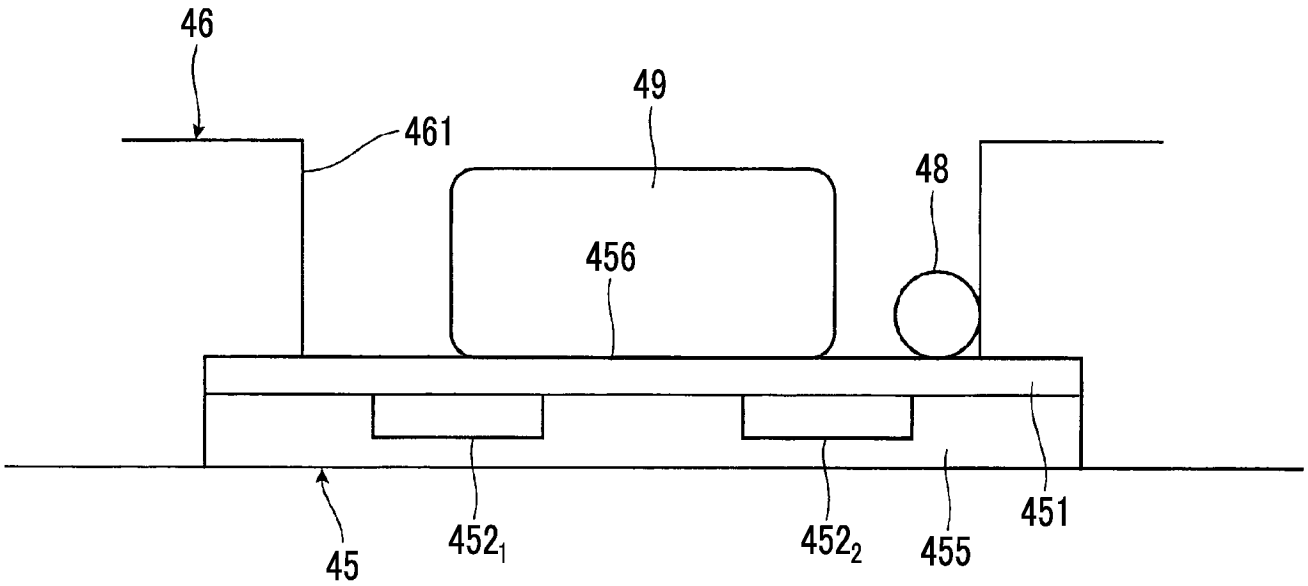
FIG. 9 is a cross-sectional configuration diagram showing major parts of a fixing device according to Exemplary Embodiment 3 of the present invention.

The holding member 46 has a support frame portion 461 that supports the ceramic heater 45 to pressurize the pressure roll 43 via the heating belt 42 at the fixing nip portion N and is made of an elongated rectangular frame corresponding to the planar shape of the ceramic heater 45 (refer to FIG. 9). The holding member 46 is disposed to be longer than the total length in the longitudinal direction of the heating belt 42.

As shown in FIG. 2, the holding member 46 is provided with a first guide portion 462 that is formed in a curved cross-sectional shape and guides the heating belt 42 to the fixing nip portion N on the upstream side of the fixing nip portion N in a rotational direction of the heating belt 42. A lower end surface 463 of the holding member 46 is formed in a planar shape. The lower end surface 463 of the holding member 46 is formed to form substantially the same plane as the surface of the ceramic heater 45. Additionally, the holding member 46 has a second guide portion 464 provided at a position adjacent to the downstream side of the fixing nip portion N in the rotational direction of the heating belt 42. The second guide portion 464 guides the heating belt 42 to be in contact with the inner surface of the heating belt 42 that has passed through the fixing nip portion N and return to a substantially free shape, and has a cross-sectional shape formed in a curved cross-sectional shape.

Additionally, abutment portions 465 and 466 that hold the support member 47 in a state where the tips of vertical plate portions 471 and 472 of the support member 47 abut against the surface of the holding member 46 opposite to the fixing nip portion N, are provided on the upstream side and the downstream side in the rotational direction of the heating belt 42.

As shown in FIG. 2, the support member 47 is made of, for example, a metallic plate material such as stainless steel, aluminum, or steel. The support member 47 is formed in a substantially U-shaped cross-section from vertical plate portions 471 and 472 that are disposed substantially perpendicular to the surface of the ceramic heater 45 on the upstream side and the downstream side of the fixing nip portion N in the rotational direction of the heating belt 42, and horizontal plate portions 473 that is disposed in the horizontal direction to connect the base end portions of the plate portions 471 and 472.

The temperature of the fixing nip portion N of the heating belt 42 is detected by a temperature sensor 49 that is disposed to be in contact with the surface of the ceramic heater 45 opposite to the fixing nip portion N. As described above, the ceramic heater 45 includes the first and second heat-generating portions $\mathbf{452}_1$ and $\mathbf{452}_2$ having different heat-generating regions in the longitudinal direction. For that reason, a plurality (for example, three) of temperature sensors 49 are disposed in the longitudinal direction of the ceramic heater 45 in correspondence with the first and second heat-generating portions $\mathbf{452}_1$ and $\mathbf{452}_2$. The heating belt 42 is heated such that the fixing nip portion N reaches a required fixing temperature (for example, about 200° C. to 230° C.) depending on the size of the recording paper 5 by controlling the energization of the first and second heat-generating portions $\mathbf{452}_1$ and $\mathbf{452}_2$ of the ceramic heater 45 on the basis of the detection result of the temperature sensor 49 by a temperature control circuit (not shown).

As shown in FIG. 2, the pressure roll 43 has a columnar or cylindrical core metal 431 made of metal such as stainless steel, aluminum, or iron (thin-walled high-tension steel pipe), an elastic body layer 432 made of a heat-resistant elastic body such as silicone rubber or fluororubber relatively thickly coated at an outer periphery of the core metal 431, and a release layer 433 made of polytetrafluoroethylene (PTFE), perfluoroalkoxyalkane (PFA), or the like relatively thinly coated on the surface of the elastic body layer 432. In addition, as necessary, a heating section (heating source) including a halogen lamp or the like may be disposed inside the pressure roll 43.

Both end portions of the core metal 431 in the longitudinal direction (axial direction) of the pressure roll 43 are rotatably supported by a frame of a device housing (not shown) of the fixing device 40 via a bearing member. The pressure roll 43 is in pressure contact with the heating unit 44 at a required pressure. The pressure roll 43 is rotationally driven at a required speed in a direction of arrow C by the drive device via a drive gear (not shown) attached to one end portion in an axial direction of the core metal 431 that also serves as a rotation shaft. In addition, the heating belt 42 is in pressure contact against the rotationally driven pressure roll 43 and rotates in a driven manner.

In the fixing device 40 configured as described above, the ceramic heater 45 is in pressure contact with the pressure roll 43 via the heating belt 42, and the heating belt 42 rotates in the counterclockwise direction in the figure with the rotation of the pressure roll 43. A lubricant such as silicone oil or grease is applied to an inner peripheral surface of the heating belt 42 in order to reduce the sliding resistance with the ceramic heater 45. The lubricant is supplied in a state of being applied to the inner peripheral surface of the heating belt 42 in advance. Additionally, the lubricant may be configured to be supplied by a lubricant supply member (not shown) made of felt or the like that holds the lubricant and is disposed to be in contact with the inner peripheral surface of the heating belt 42.

Figure 4:
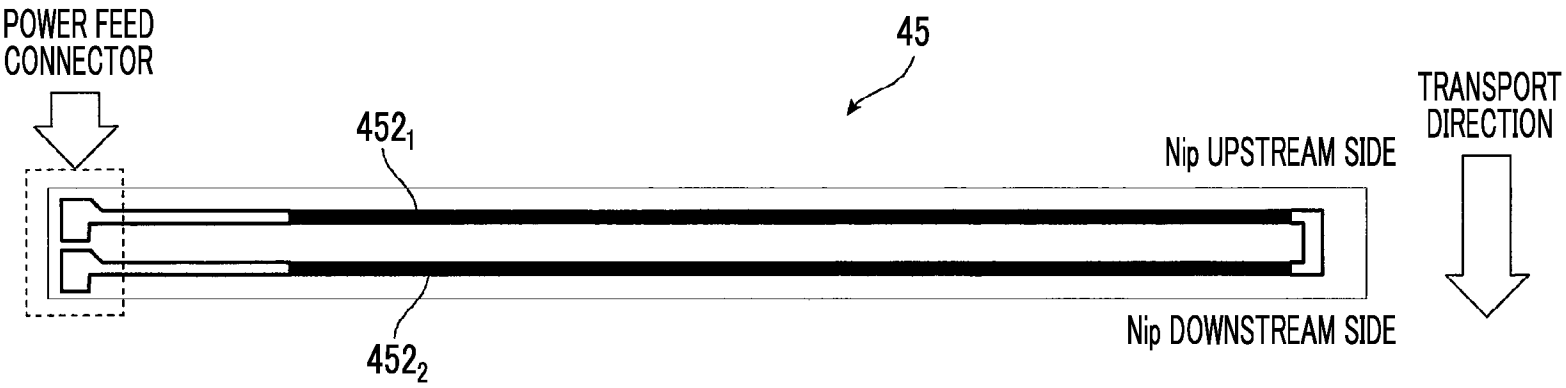
FIG. 4 RELATED ART
FIG. 4 is a configuration diagram showing major parts of a related-art fixing device.
Figure 5A:
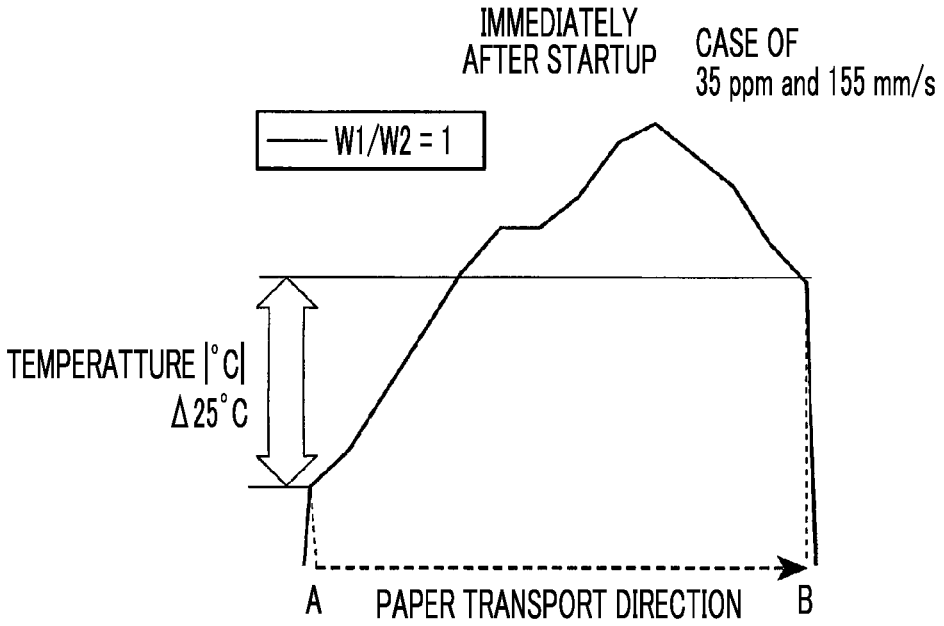
FIG. 5A RELATED ART
FIGS. 5A and 5B are graphs showing the characteristics of a related-art fixing device.

In the related-art fixing device 40, as shown in FIG. 4, the first and second heat-generating portions $\mathbf{452}_1$ and $\mathbf{452}_2$ of the ceramic heater 45 disposed in a movement direction of the heating belt 42 are set to have the same heat generation amount. For that reason, as shown in FIG. 5A, at the time of startup, in a case where the fixing device 40 starts the energization to the ceramic heater 45 and rotates the heating belt 42, the ceramic heater 45 is deprived of heat in the movement direction of the heating belt 42, and the temperature on the upstream side in the movement direction of the heating belt 42 becomes drastically lower than the temperature on the downstream side. In this case, in order to fix images on 35 sheets of A4 size recording paper 5 per minute in the fixing device 40, in a case where the movement speed of the heating belt 42 is set to 155 mm/sec, a temperature difference between an upstream end portion and a downstream end portion of the ceramic heater 45 in the movement direction of the heating belt 42 reaches about 25° C.

Figure 5B:
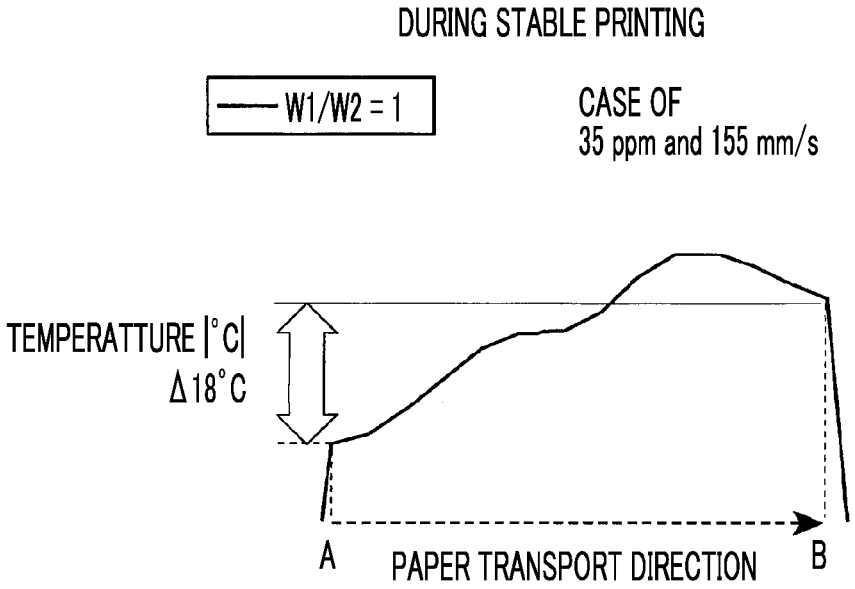
FIG. 5B RELATED ART

In the fixing device 40, as shown in FIG. 5B, in a case where the recording paper 5 is passed through the fixing nip portion N in order to fix the unfixed toner image on the recording paper 5 during the fixing operation, the temperature difference between the upstream end portion and the downstream end portion of the ceramic heater 45 in the movement direction of the heating belt 42 under the same conditions is about 18° C., although lower than the temperature difference at the time of startup.

In this way, in the related-art fixing device 40, at the time of startup, the temperature difference between the upstream end portion and the downstream end portion in the movement direction of the heating belt 42 of the ceramic heater 45 reaches about 25°. Even during the fixing operation, the temperature difference between the upstream end portion and the downstream end portion in the movement direction of the heating belt 42 of the ceramic heater 45 is as drastically large as about 18° C.

For that reason, in the related-art fixing device 40, in a case where the heat generation amount of the ceramic heater 45 is increased to realize a high productivity of 35 ppm and the fixing of the recording paper 5 having a relatively large basis weight is enabled, technical challenges occur in that the temperature difference between the upstream end portion and the downstream end portion in the movement direction of the heating belt 42 of the ceramic heater 45 is large, and the holding member 46 made of heat-resistant synthetic resin that holds the ceramic heater 45 is thermally damaged.

Thus, the fixing device according to Exemplary Embodiment 1 is configured to includes a planar heat-generating section which is disposed inside a belt and in which, among a plurality of heat-generating portions provided in a movement direction of the belt, a heat-generating portion on an upstream side in the movement direction of the belt has a larger heat generation amount than a heat-generating portion on a downstream side.

Additionally, the fixing device according to Exemplary Embodiment 1 is configured such that the heat generation amount of the heat-generating portion on the upstream side in the movement direction of the belt is 1.5 times or more and 2.0 times or less than the heat generation amount the heat generation amount of the heat-generating portion on the downstream side.

Figure 6:
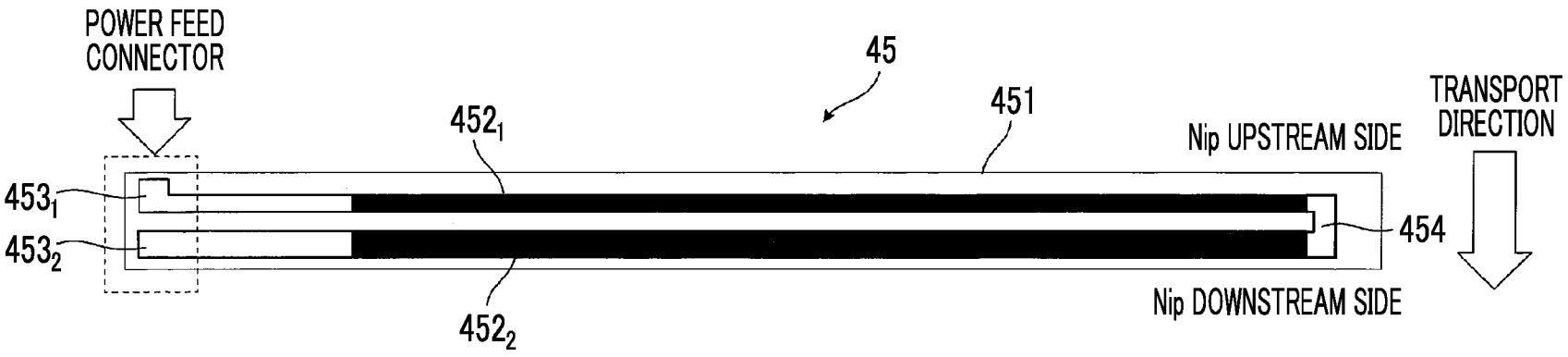
FIG. 6 is a plan configuration diagram showing a ceramic heater of the fixing device according to Exemplary Embodiment 1 of the present invention.

That is, as shown in FIG. 6, the ceramic heater 45 of the fixing device 40 according to Exemplary Embodiment 1 includes the ceramic substrate 451, the plurality of first and second heat-generating portions $\mathbf{452}_1$ and $\mathbf{452}_2$ that are linearly formed on the surface of and the substrate 451 to be parallel to each other in the longitudinal direction, first and second electrodes $\mathbf{453}_1$ and $\mathbf{453}_2$ for simultaneously energizing the first and second heat-generating portions $\mathbf{452}_1$ and $\mathbf{452}_2$, a connection electrode 454 that connects the other end portions of the first and second heat-generating portions $\mathbf{452}_1$ and $\mathbf{452}_2$ to each other in series, and the coating layer 455 (refer to FIG. 2) made of glass or the like that is coated on at least the surfaces of the first and second heat-generating portions $\mathbf{452}_1$ and $\mathbf{452}_2$.

As described above, the first and second heat-generating portions $\mathbf{452}_1$ and $\mathbf{452}_2$ are linearly formed on the surface of the substrate 451 to be parallel to each other in the longitudinal direction. Additionally, the first and second heat-generating portions $\mathbf{452}_1$ and $\mathbf{452}_2$ are disposed such that the first heat-generating portion $\mathbf{452}_1$ is located on the upstream side in the rotational direction of the heating belt 42 and the second heat-generating portion $\mathbf{452}_2$ is disposed to be located on the downstream side in the rotational direction of the heating belt 42.

Additionally, the first heat-generating portion $\mathbf{452}_1$ is set to have a larger heat generation amount than the second heat-generating portion $\mathbf{452}_2$. The heat generation amounts of the first and second heat-generating portions $\mathbf{452}_1$ and $\mathbf{452}_2$ are set by making at least any one of the widths, the film thicknesses, or the resistivities of heat-generating resistors constituting the first and second heat-generating portions $\mathbf{452}_1$ and $\mathbf{452}_2$ different from each other.

In Exemplary Embodiment 1, the first and second heat-generating portions $\mathbf{452}_1$ and $\mathbf{452}_2$ are connected to each other in series, and current values I flowing through both heat-generating portions are equal to each other. Meanwhile, the second heat-generating portion $\mathbf{452}_2$ is set to have a smaller line width W and a larger resistance value than the first heat-generating portion $\mathbf{452}_1$. The first and second heat-generating portions $\mathbf{452}_1$ and $\mathbf{452}_2$ are formed by linearly patterning and baking materials having electrical resistance in the shape of the first and second heat-generating portions $\mathbf{452}_1$ and $\mathbf{452}_2$ on the surface of the ceramic substrate 451. The materials having electrical resistance forming the first and second heat-generating portions $\mathbf{452}_1$ and $\mathbf{452}_2$ are linearly formed to have the same thickness and different line widths. For that reason, the second heat-generating portion $\mathbf{452}_2$, which has a larger line width than the first heat-generating portion $\mathbf{452}_1$, has a smaller electrical resistance value than the first heat-generating portion $\mathbf{452}_1$ by a larger line width, and has a smaller heat generation amount (W) than the first heat-generating portion $\mathbf{452}_1$.

The first heat-generating portion $\mathbf{452}_1$ is set to have a heat generation amount of 1.5 times or more and 2.0 times or less than the heat generation amount of the second heat-generating portion $\mathbf{452}_2$. In a case where the heat generation amount of the first heat-generating portion $\mathbf{452}_1$ is less than 1.5 times the heat generation amount of the second heat-generating portion $\mathbf{452}_2$, a temperature distribution is obtained that becomes higher on the downstream side in the rotational direction of the heating belt 42, and the heating efficiency of the heating belt 42 and the recording paper 5 becomes low. Additionally, in a case where the heat generation amount of the first heat-generating portion $\mathbf{452}_1$ exceeds 2.0 times the heat generation amount of the second heat-generating portion $\mathbf{452}_2$, there is a concern that a temperature distribution is obtained that becomes too high on the upstream side in the rotational direction of the heating belt 42, the heating efficiency of the heating belt 42 and the recording paper 5 decreases, and a thermal shock is given to the ceramic heater 45 due to the difference between the heat generation amounts of the first and second heat-generating portions $\mathbf{452}_1$ and $\mathbf{452}_2$.

In addition, in order to make the heat generation amounts of the first and second heat generating portions $\mathbf{452}_1$ and $\mathbf{452}_2$ different from each other, as described above, at least any one of the widths, the film thicknesses, or the resistivities of the heat-generating resistor constituting the first and second heat-generating portions $\mathbf{452}_1$ and $\mathbf{452}_2$ may be made different from each other. However, in a case where the heat generation amounts of the first and second heat-generating portions $\mathbf{452}_1$ and $\mathbf{452}_2$ are made different from each other by making the line widths W of the heat generating resistors constituting the first and second heat-generating portions $\mathbf{452}_1$ and $\mathbf{452}_2$ different from each other, it is only necessary to make the line widths in a case where the first and second heat-generating portions $\mathbf{452}_1$ and $\mathbf{452}_2$ are linearly patterned different from each other. Thus, the formation (manufacture) is easy as compared to a case where the film thicknesses or resistivities of the heat-generating resistors are made different from each other.

Additionally, the first and second heat-generating portions $452_1$ and $452_2$ may have at least any one of the widths, the film thicknesses and the resistivities of the heat-generating resistors constituting the first and second heat-generating portions $452_1$ and $452_2$ different from each other. However, two or more of the widths, the film thicknesses, and the resistivities of the heat-generating resistors may be different from each other. In this case, the heat generation amounts of the first and second heat-generating portions $452_1$ and $452_2$ can be greatly different from each other.

Operation of Fixing Device

In the fixing device according to Exemplary Embodiment 1, as compared to a case where the heat generation amounts of the plurality of heat-generating portions provided in the movement direction of the belt are equal to each other, it is possible to make the temperature distribution of the planar heat-generating section in the movement direction of the belt uniform.

That is, as shown in FIG. 2, in the fixing device 40 according to Exemplary Embodiment 1, at the time of startup, the first and second heat-generating portions $452_1$ and $452_2$ of the ceramic heater 45 are energized, and the heating belt 42 is rotated in a driven manner by the pressure roll 43 that is rotationally driven.

In the ceramic heater 45 of the fixing device 40, the heat generation amount of the second heat-generating portion $452_2$ located on the downstream side in the rotational direction of the heating belt 42 is set to be larger than the heat generation amount of the first heat-generating portion $452_1$ located on the upstream side in the rotational direction of the heating belt 42.

For that reason, in the fixing device 40, the heating belt 42 is rotated in the counterclockwise direction in the figure, and the heating belt 42 that has passed through an air layer located in a space inside the fixing device 40 enters the fixing nip portion N. At the time of startup, the recording paper 5 is not passed through the fixing device 40, and only the heating belt 42 passes through the fixing nip portion N.

Therefore, the ceramic heater 45, which is in contact with the pressure roll 43 via the heating belt 42, is deprived of heat by the heating belt 42 and the pressure roll 43, and the temperature thereof drops.

Meanwhile, the fixing device 40 according to Exemplary Embodiment 1 is configured such that the second heat-generating portion $452_2$ located on the downstream side in the rotational direction of the heating belt 42 is larger than the first heat-generating portion $452_1$ located on the upstream side in the rotational direction of the heating belt 42 in terms of the heat generation amounts of the first and second heat-generating portions $452_1$ and $452_2$ of the ceramic heater 45.

For that reason, the temperature of the ceramic heater 45 of the fixing device 40 tends to further decrease on the upstream side in the rotational direction of the heating belt 42 compared to on the downstream side because heat is deprived of by the heating belt 42 and the pressure roll 43. However, the first heat-generating portion $452_1$ located on the upstream side in the rotational direction of the heating belt 42 is set to have a large heat generation amount than the second heat-generating portion $452_2$ located on the downstream side in the rotational direction of the heating belt 42.

Figure 7A:
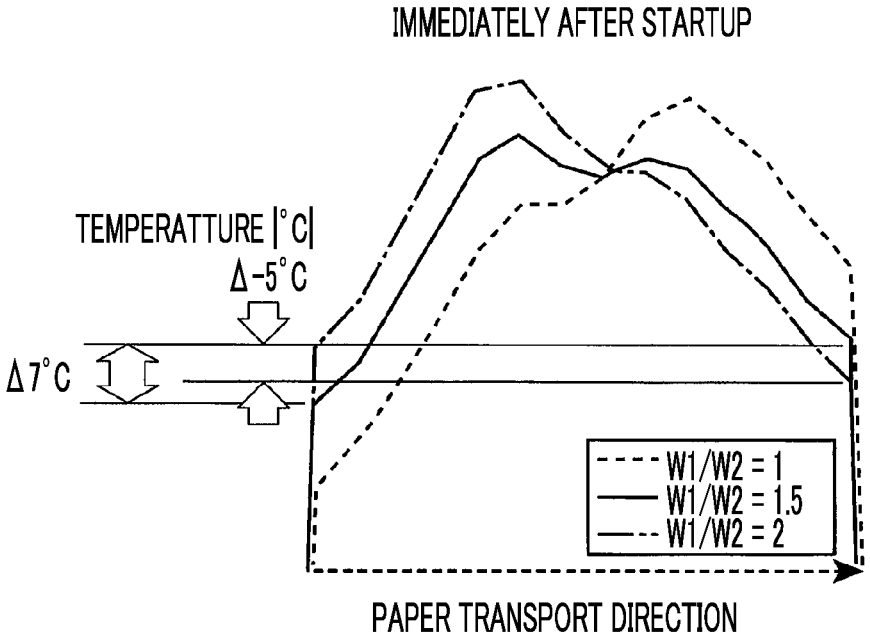
FIGS. 7A and 7B are graphs showing the action of the fixing device according to Exemplary Embodiment 1 of the present invention.

Therefore, in the fixing device 40, as shown in FIG. 7A, at the time of startup, in a case where the energization to the ceramic heater 45 is started and the heating belt 42 is rotated, heat tends to be further deprived of on the upstream side in the movement direction of the ceramic heater 45 in the movement direction of the heating belt 42 than on the downstream side. However, since the heat generation amount of the first heat-generating portion $452_1$ located on the upstream side in the rotational direction of the heating belt 42 is larger than the heat generation amount of the second heat-generating portion $452_2$ located on the downstream side, a temperature drop on the upstream side of the ceramic heater 45 in the movement direction of the heating belt 42 is suppressed.

As a result, in the fixing device 40, at the time of startup, in a case where the ratio of the heat generation amounts of the first heat-generating portion $452_1$ and the second heat-generating portion $452_2$ is set to 1.5, the temperature difference between the upstream side and the downstream side of the ceramic heater 45 in the movement direction of the heating belt 42 is about 7° C., which is 10° C. or lower, and in a case where the ratio of the heat generation amounts of the first heat-generating portion $452_1$ and the second heat-generating portion $452_2$ is set to 2.0, the temperature difference between the upstream side and the downstream side of the ceramic heater 45 in the movement direction of the heating belt 42 is about 5° C. As a result, the temperature difference between the upstream side and the downstream side of the ceramic heater 45 in the movement direction of the heating belt 42 is drastically suppressed.

Figure 7B:
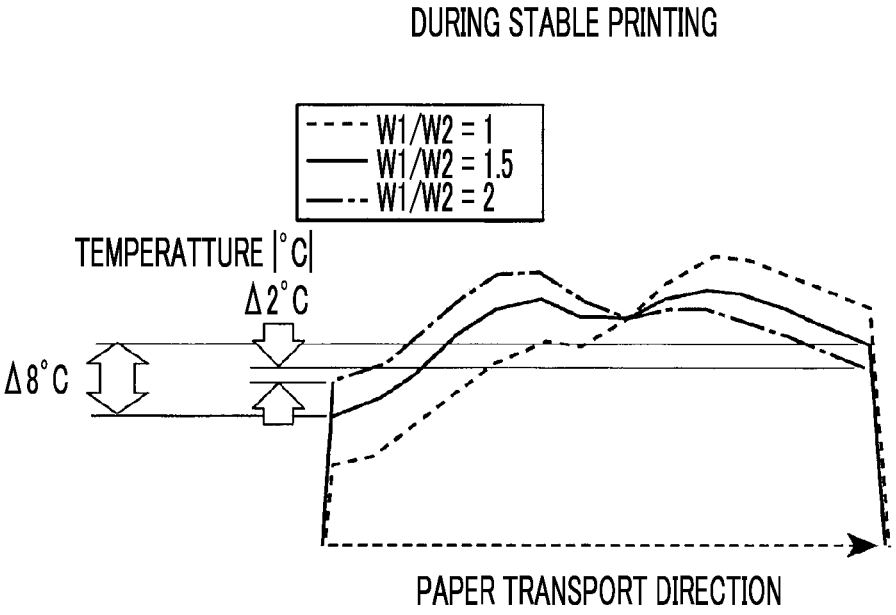

Additionally, in the fixing device 40, as shown in FIG. 7B, in a case where the printing operation in which the recording paper 5 is continuously passed is stable and in a case where the ratio of the heat generation amounts of the first heat-generating portion $452_1$ and the second heat-generating portion $452_2$ is set to 1.5, the temperature difference between the upstream side and the downstream side of the ceramic heater 45 in the movement direction of the heating belt 42 is about 8° C., which is 10° C. or lower, and in a case where the ratio of the heat generation amounts of the first heat-generating portion $452_1$ and the second heat-generating portion $452_2$ is set to 2.0, the temperature difference between the upstream side and the downstream side of the ceramic heater 45 in the movement direction of the heating belt 42 is about 2° C. As a result, the temperatures on the upstream side and the downstream side of the ceramic heater 45 in the movement direction of the heating belt 42 can be made uniform to be substantially equal to each other.

In the fixing device 40 according to Exemplary Embodiment 1, the heat generation amount of the first heat-generating portion $452_1$ located on the upstream side in the rotational direction of the heating belt 42 is set to be larger than the heat generation amount of the second heat-generating portion $452_2$ located on the downstream side in the rotational direction of the heating belt 42. In other words, it can be said that the heat generation amount of the first heat-generating portion $452_1$ located on the upstream side in the rotational direction of the heating belt 42 is set to be larger than the heat generation amount of the second heat-generating portion $452_2$ located on the downstream side in the rotational direction of the heating belt 42 such that, during heating, the temperatures on the upstream side and the downstream side of the ceramic heater 45 in the movement direction of the heating belt 42 are set to 10° C. or lower.

For that reason, in the fixing device 40 according to Exemplary embodiment 1, even in a case where the heat generation amount of the ceramic heater 45 is increased compared to the related art to realize a high productivity of 70 ppm and the fixing of the recording paper 5 having a relatively large basis weight is enabled, it is possible to make the temperature difference between the upstream end portion and the downstream end portion of the ceramic heater 45 in the movement direction of the heating belt 42 extremely small, and it is possible to suppress giving thermal damage to the holding member 46 made of heat-resistant synthetic resin that holds the ceramic heater 45.

Exemplary Embodiment 2

Figure 8:
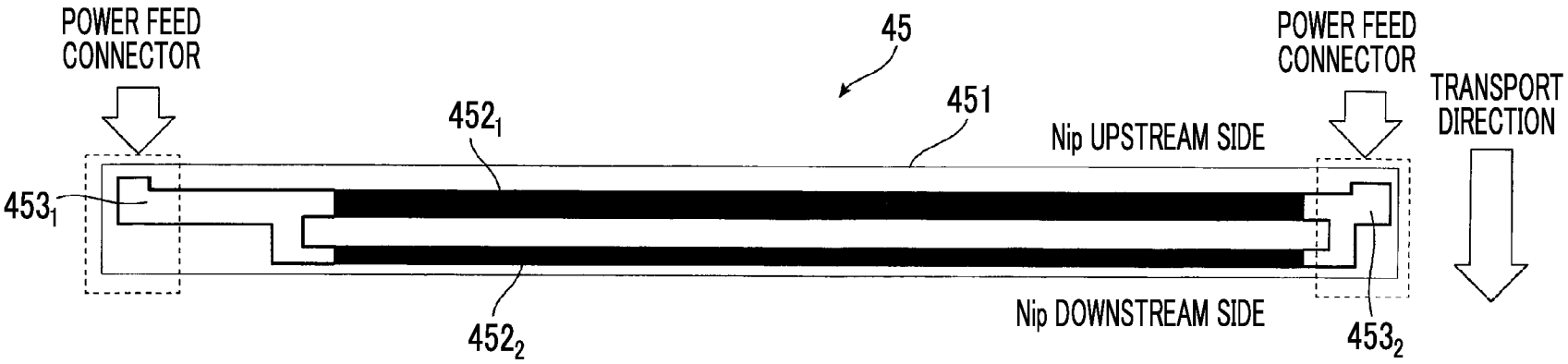
FIG. 8 is a plan configuration diagram showing a ceramic heater of a fixing device according to Exemplary Embodiment 2 of the present invention.

FIG. 8 is a configuration diagram showing major parts of a fixing device according to Exemplary Embodiment 2 of the present invention.

The fixing device according to Exemplary Embodiment 2 is configured such that a heat-generating portion located on an upstream side in a movement direction of a belt and a heat-generating portion located on a downstream side in the movement direction of the belt are connected in parallel to each other and both ends of the heat-generating portion on the upstream side in the movement direction and the heat-generating portion on the downstream side in the movement direction of the belt are respectively energized.

That is, as shown in FIG. 8, the ceramic heater 45 of the fixing device 40 according to Exemplary Embodiment 2 includes the ceramic substrate 451, the plurality of first and second heat-generating portions $\mathbf{452}_1$ and $\mathbf{452}_2$ that are linearly formed on the surface of and the substrate 451 to be parallel to each other in the longitudinal direction, the first electrodes $\mathbf{453}_1$ for simultaneously (in parallel) energizing one end portions of the first and second heat-generating portions $\mathbf{452}_1$ and $\mathbf{452}_2$, a second electrode $\mathbf{453}_2$ for simultaneously (in parallel) energizing the other end portions of the first and second heat-generating portions $\mathbf{452}_1$ and $\mathbf{452}_2$ to each other, and the coating layer 455 (refer to FIG. 2) made of glass or the like that is coated on at least the surfaces of the first and second heat-generating portions $\mathbf{452}_1$ and $\mathbf{452}_2$.

The first and second heat-generating portions $\mathbf{452}_1$ and $\mathbf{452}_2$ are linearly formed on the surface of the substrate 451 to be parallel to each other in the longitudinal direction. Additionally, the first and second heat-generating portions $\mathbf{452}_1$ and $\mathbf{452}_2$ are disposed such that the first heat-generating portion $\mathbf{452}_1$ is located on the upstream side in the rotational direction of the heating belt 42 and the second heat-generating portion $\mathbf{452}_2$ is disposed to be located on the downstream side in the rotational direction of the heating belt 42.

Additionally, the first heat-generating portion $\mathbf{452}_1$ is set to have a larger heat generation amount than the second heat-generating portion $\mathbf{452}_2$.

In Exemplary Embodiment 1, the first and second heat-generating portions $\mathbf{452}_1$ and $\mathbf{452}_2$ are connected to each other in parallel, and voltage values V applied to both are equal. Meanwhile, the first heat-generating portion $\mathbf{452}_1$ having a larger line width than the second heat-generating portion $\mathbf{452}_2$ has a smaller electrical resistance value than the second heat-generating portion $\mathbf{452}_2$ by a larger line width.

The heat generation amounts $W_1$ and $W_2$ of the first and second heat-generating portions $\mathbf{452}_1$ and $\mathbf{452}_2$ are given as the product of the voltage value V applied to the first and second heat-generating portions 4521 and 4522 and current values $I_1$ and $I_2$ flowing through the first and second heat-generating portions $\mathbf{452}_1$ and $\mathbf{452}_2$.

$$W_1=I_1\times V$$

$$W_2=I_2\times V$$

Here, assuming that the resistance values of the first and second heat-generating portions $\mathbf{452}_1$ and $\mathbf{452}_2$ are $R_1$ and $R_2$, $$I_1=V/R_1$$

$$I_2=V/R_2$$

Thus, $$W_1=V^2/R_1$$

$$W_2=V^2/R_2$$

Will be.

Additionally, the resistance values $R_1$ and $R_2$ of the first and second heat-generating portions $\mathbf{452}_1$ and $\mathbf{452}_2$ have a relationship that the line width $W_1$ of the first heat-generating portion $\mathbf{452}_1$ is larger than the line width $W_2$ of the second heat-generating portion $\mathbf{452}_2$ and $R_1<R_2$ is established.

Therefore, the heat generation amounts $W_1$ and $W_2$ of the first and second heat-generating portions $\mathbf{452}_1$ and $\mathbf{452}_2$ are set to be larger in the first heat-generating portion $\mathbf{452}_1$ than in the second heat-generating portion $\mathbf{452}_2$.

In the fixing device according to Exemplary Embodiment 2, by connecting the first and second heat-generating portions $\mathbf{452}_1$ and $\mathbf{452}_2$ to each other in parallel, it is possible to increase the heat generation amount of the heat-generating portion on the upstream side in the movement direction of the heating belt 42 with the same applied voltage, compared to a case where the heat-generating portion on the upstream side in the movement direction of the heating belt 42 and the heat-generating portion on the downstream side in the movement direction of the belt are connected to each other in series.

In addition, in the fixing device according to Exemplary Embodiment 2, the heat-generating regions of the first and second heat-generating portions $\mathbf{452}_1$ and $\mathbf{452}_2$ in the longitudinal direction are not necessarily the same (constant), and heat-generating regions along the first and second heat-generating portions $\mathbf{452}_1$ and $\mathbf{452}_2$ may be configured to be different from each other depending on the size (width) of the recording paper 5 in the direction intersecting as the transport direction.

In the fixing device according to Exemplary Embodiment 2, the number of heat-generating portions $\mathbf{452}_1$ and $\mathbf{452}_2$ is not limited to two, and may be three or more.

Since the other configurations and actions are the same as the configurations and actions of Exemplary Embodiment 1, the description thereof will be omitted.

Exemplary Embodiment 3

FIG. 9 is a configuration diagram showing major parts of a fixing device according to Exemplary Embodiment 3 of the present invention.

The fixing device according to Exemplary Embodiment 3 is configured to include a heat pipe that is disposed to be in contact with the surface of the planar heat-generating section opposite to the belt closer to the end portion than the heat-generating portion on the downstream side in the movement direction of the belt.

That is, in the fixing device 40 according to Exemplary Embodiment 3, as shown in FIG. 9, the heat pipe 48 is disposed to be in contact with the back surface of the ceramic heater 45 closer to the end portion than the second heat-generating portion $\mathbf{452}_2$ on the downstream side in the rotational direction of the heating belt 42.

By configuring the present invention in this way, as shown in FIGS. 7A and 7B, it is possible to further suppress a temperature rise at a portion closer to the end portion than the second heat-generating portion $\mathbf{452}_2$ on the downstream side in the rotational direction of the heating belt 42 whose temperature tends to rise higher than on the upstream side of the ceramic heater 45 in the rotational direction of the heating belt 42, by the heat pipe 48.

Since the other configurations and actions are the same as the configurations and actions of Exemplary Embodiment 1, the description thereof will be omitted.

In addition, in the above exemplary embodiments, the case where the ceramic heater is used as the planar heat-generating section has been described, but the planar heat-generating section is not limited to the ceramic heater, and anything that generates heat literally in a planar manner at the fixing nip portion N may be used.

Additionally, in the above-described exemplary embodiments, the case where the pressure roll is used as the pressurizing section has been described, but a pressure belt may be used as the pressurizing section.

Additionally, although the present invention has been described with the electrophotographic image forming apparatus, the present invention is not limited to the electrophotographic image forming apparatus. For example, it is also possible to apply the present invention to an ink jet type image forming apparatus or the like in which an unfixed ink image is fixed on paper in contact with the paper transported while holding an image of an undried layer with ink (an unfixed ink image).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a movable belt;

a planar heat-generating section that is in contact with the belt and in which, among a plurality of heat-generating portions provided in a movement direction of the belt, a heat-generating portion on an upstream side in the movement direction of the belt has a larger heat generation amount than a heat-generating portion on a downstream side; and a heat pipe that is disposed to be in contact with a surface of the planar heat-generating section opposite to the belt closer to an end portion of the planar heat-generating section than the heat-generating portion on the downstream side in the movement direction of the belt.

2. The fixing device according to claim 1, wherein the heat-generating portion on the upstream side in the movement direction of the belt has a heat generation amount of 1.5 times or more and 2.0 times or less than a heat generation amount of the heat-generating portion on the downstream side.

3. The fixing device according to claim 2, wherein the heat-generating portion on the upstream side in the movement direction of the belt and the heat-generating portion on the downstream side in the movement direction of the belt are connected to each other in series, and one end of the heat-generating portion on the upstream side in the movement direction of the belt and the other end of the heat-generating portion on the downstream side in the movement direction of the belt are energized.

4. The fixing device according to claim 3, wherein the heat-generating portion on the upstream side in the movement direction of the belt and the heat-generating portion on the downstream side in the movement direction of the belt are different from each other in terms of at least any one of a width, a film thickness, and a resistivity of a heat-generating resistor constituting the heat-generating portion.

5. The fixing device according to claim 2, wherein the heat-generating portion located on the upstream side in the movement direction of the belt and the heat-generating portion located on the downstream side in the movement direction of the belt are connected to each other in parallel, and both ends of the heat-generating portions on the upstream side and on the downstream side in the movement direction of the belt are energized, respectively.

6. The fixing device according to claim 5, wherein the heat-generating portion on the upstream side in the movement direction of the belt and the heat-generating portion on the downstream side in the movement direction of the belt are different from each other in terms of at least any one of a width, a film thickness, and a resistivity of a heat-generating resistor constituting the heat-generating portion.

7. The fixing device according to claim 1, wherein the heat-generating portion on the upstream side in the movement direction of the belt and the heat-generating portion on the downstream side in the movement direction of the belt are connected to each other in series, and one end of the heat-generating portion on the upstream side in the movement direction of the belt and the other end of the heat-generating portion on the downstream side in the movement direction of the belt are energized.

8. The fixing device according to claim 7, wherein the heat-generating portion on the upstream side in the movement direction of the belt and the heat-generating portion on the downstream side in the movement direction of the belt are different from each other in terms of at least any one of a width, a film thickness, and a resistivity of a heat-generating resistor constituting the heat-generating portion.

9. The fixing device according to claim 1, wherein the heat-generating portion located on the upstream side in the movement direction of the belt and the heat-generating portion located on the downstream side in the movement direction of the belt are connected to each other in parallel, and both ends of the heat-generating portions on the upstream side and on the downstream side in the movement direction of the belt are energized, respectively.

10. The fixing device according to claim 9, wherein the heat-generating portion on the upstream side in the movement direction of the belt and the heat-generating portion on the downstream side in the movement direction of the belt are different from each other in tennis of at least any one of a width, a film thickness, and a resistivity of a heat-generating resistor constituting the heat-generating portion.

11. The fixing device according to claim 1, wherein the planar heat-generating section is held by a holding section to be in pressure contact with a rotating body via the belt.

12. The fixing device according to claim 11, wherein the holding section holds at least both end portions of the planar heat-generating section outside the heat-generating portions in the movement direction of the belt.

13. An image forming apparatus comprising:

an image forming section that forms an image on a recording medium; and a fixing section that fixes the image formed on the recording medium, wherein the fixing device according to claim 1 is used as the fixing section.

14. A fixing device comprising:

a movable belt;

a planar heat-generating section that is in contact with the belt and is provided with a plurality of heat-generating portions on an insulating substrate in a movement direction of the belt, the plurality of heat-generating portions being adapted such that a heat-generating portion on an upstream side in the movement direction of the belt is set to have a larger heat generation amount than a heat-generating portion on a downstream side such that a temperature difference between an upstream end portion and a downstream end portion of the insulating substrate in the movement direction of the belt is 10° C. or lower at the time of fixing; and a heat pipe that is disposed to be in contact with a surface of the planar heat-generating section opposite to the belt closer to an end portion of the planar heat-generating section than the heat-generating portion on the downstream side in the movement direction of the belt.

15. A fixing device comprising:

a movable belt; and a planar heat-generating section that is in contact with the belt and in which, among a plurality of heat-generating portions provided in a movement direction of the belt, a heat-generating portion on an upstream side in the movement direction of the belt has a larger heat generation amount than a heat-generating portion on a downstream side, wherein the heat-generating portion located on the upstream side in the movement direction of the belt and the heat-generating portion located on the downstream side in the movement direction of the belt are connected to each other in parallel, wherein one ends of the heat-generating portions on the upstream side in the movement direction of the belt are simultaneously energized, and the other ends of the heat-generating portions on the downstream side in the movement direction of the belt are simultaneously energized.

* * * * *